US006517681B1

(12) United States Patent
Koskinen et al.

(10) Patent No.: US 6,517,681 B1
(45) Date of Patent: Feb. 11, 2003

(54) METHOD AND DEVICE FOR CHANGING AN ENDLESS FELT

(75) Inventors: Jorma Koskinen, Kotka (FI); Esa Markkanen, Kotka (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/554,179

(22) PCT Filed: Nov. 10, 1998

(86) PCT No.: PCT/FI98/00871

§ 371 (c)(1),
(2), (4) Date: Jul. 12, 2000

(87) PCT Pub. No.: WO99/28550

PCT Pub. Date: Jun. 10, 1999

(30) Foreign Application Priority Data

Nov. 17, 1997 (FI) ..... 974261

(51) Int. Cl.[7] ..... D21F 1/24

(52) U.S. Cl. ..... 162/199; 162/200; 162/273; 162/272

(58) Field of Search ..... 162/199, 200, 162/272, 273, 274, 358.1; 198/617, 804, 841; 74/242.7

(56) References Cited

U.S. PATENT DOCUMENTS 2,681,721 A * 6/1954 Baxter, Jr. et al. ..... 198/313
2,938,581 A * 5/1960 Beachler ..... 162/273
2,950,224 A * 8/1960 Balough ..... 162/199
4,127,441 A * 11/1978 Stegelitz ..... 162/200
4,138,316 A * 2/1979 Kessler et al. ..... 162/200
4,200,490 A * 4/1980 O'Hagan ..... 162/200
4,267,018 A * 5/1981 Haltsonen et al. ..... 162/200
4,321,109 A * 3/1982 Haltsonen et al. ..... 162/274
4,481,078 A * 11/1984 Niemi ..... 162/199
4,657,634 A * 4/1987 Autio ..... 162/199
4,699,692 A * 10/1987 Autio ..... 162/199
4,735,689 A * 4/1988 Kotitschke et al. ..... 162/273
4,948,465 A * 8/1990 Rantala ..... 162/199

FOREIGN PATENT DOCUMENTS

FI 80095 12/1989

* cited by examiner

*Primary Examiner*—Jose A. Fortuna
(74) *Attorney, Agent, or Firm*—Merchant & Gould, P.C.

(57) ABSTRACT

Felt changing device and procedure for changing an endless felt, in which procedure an endless felt is placed around rollers. In the procedure, an elongated lifting beam (4) with the endless felt (5) placed around it is attached to the first end (3) of a first roller (1). The fixtures holding the first end of the first roller secured are released and the first end of the roller, supported by the lifting beam, is raised. The felt around the lifting beam is passed under the first roller and around the first roller and the other rollers (2) and the first roller is lowered and secured.

20 Claims, 5 Drawing Sheets

METHOD AND DEVICE FOR CHANGING AN ENDLESS FELT

Figure 1:
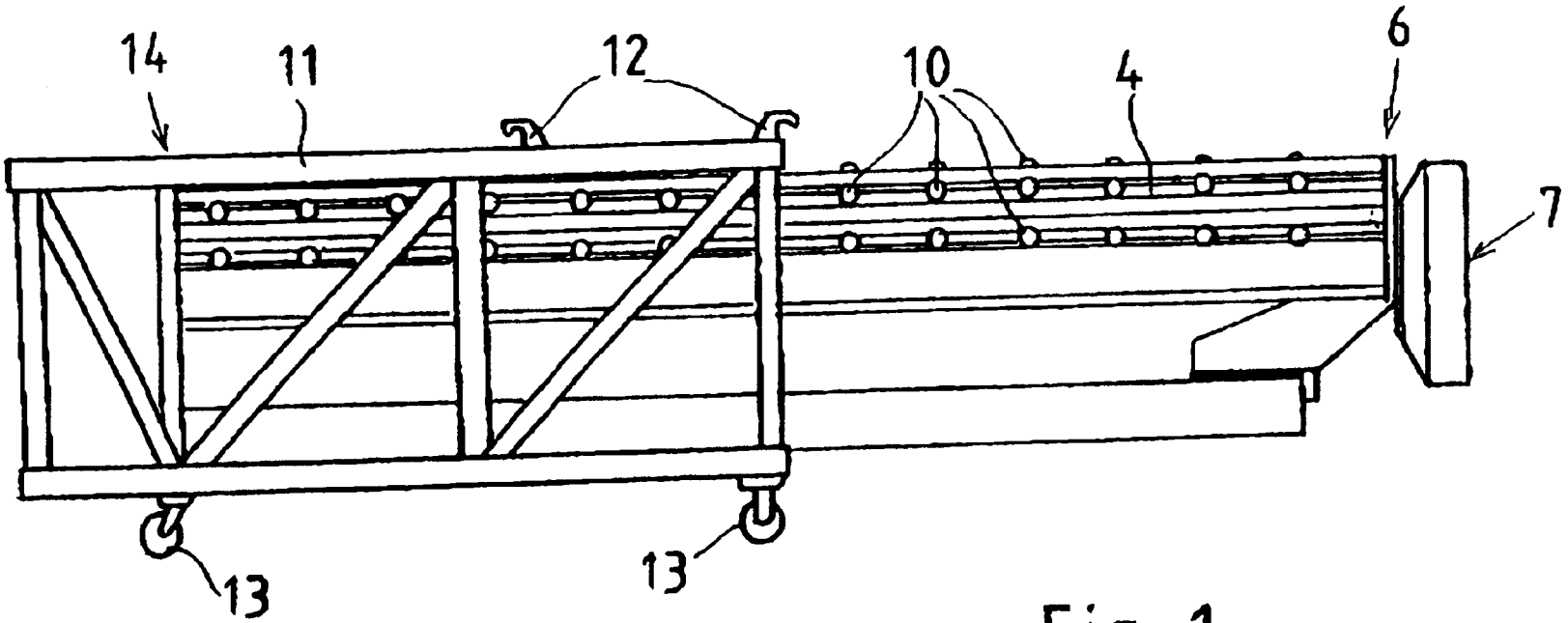

The present invention relates to a procedure and device for changing an endless felt.

The invention is designed especially for the changing of the upper felt in the press of a chemical-pulp drying machine, which is mainly the context in which it will be described in the following, but it can just as well be applied in the changing of other felts in chemical-pulp, paper or cardboard machines.

Traditionally, the presses in chemical-pulp drying machines are of a cantilevered type, and a felt change is performed by removing the spacers on the press roller and/or operating side of the frame and supporting the press roller by means of cantilever girders from the driving side to produce a gap into which the felt can be inserted. After this, the endless felt is spread out on the floor on the operating side, from where it is then lifted onto the press using suitable lifting apparatus while at the same time its lower part is being red into the gap thus opened. Once the felt has been passed into position and straightened, the spacers are mounted again and the felt is tightened in position.

However, there are several drawbacks in prior-art technology. In a cantilevered machine, changing the felt is a difficult and slow operation that takes several hours. When the felt is spread out on the floor on the operating side and when it is being installed in the machine, it becomes soiled with dirt and grease and it is also creased, so it is not immediately usable after installation but has to be cleaned, which further prolongs the down-time. Moreover, press felts currently used are thicker and heavier than before, so they are difficult to handle and pass between the rollers. Likewise, there is a high risk of the felts being damaged during installation as they get creased and bent.

A further drawback in cantilevered presses currently used is that the cantilever system requires a heavy structure, long beams and a large space on the driving side, in addition to the structural engineering requirements relating to the machine room floor.

The object of the present invention is to eliminate the drawbacks mentioned above. A specific object of the present invention is to disclose a new type of procedure and a corresponding device which allow a simpler and faster felt change operation and which also permit a substantially simpler and cheaper structure of the machine in which the felt is used.

In the procedure of the invention for changing an endless felt, the felt is placed around the rollers by raising a first roller and passing the felt around the first roller as well as the other rollers to go inside the felt loop. According to the invention, the endless felt is placed around an elongated lifting beam and the lifting beam is attached to the first end of the first roller. Next, the fixtures attaching the first end of the first roller to the frame are released, whereupon the first end of the roller can be raised, supported by the lifting beam. The felt around the lifting beam can now be passed under the raised first roller and around the first roller and the other rollers to go inside the felt loop, whereupon the first roller is lowered and secured in place. After this, the lifting beam can be released from the first roller.

Preferably before the new felt is passed into position, the rollers to go inside the felt are moved closer to each other to facilitate installation of the felt. Correspondingly, after the felt has been installed, at is tightened in position by moving the rollers inside the felt farther apart from each other.

The procedure can be applied to change the felts in the press of a chemical pulp, paper or cardboard machine, preferably upper felts, in which case the first roller is the upper roller of the press.

In the procedure of the invention, only as much of the endless felt loop is unwound from the roll as is needed to allow it to be placed around a lifting beam while the rest of the felt remains rolled up, supported by the lifting beam. Thus, it is not necessary to spread the entire felt on the floor, where it would get soiled and creased. This is also an easier way to handle the felt.

In the procedure of the invention, only a portion of the felt is unwound from the roll at first and the entire felt is continuously kept straight in its whole width, and it need not be creased or bent in any way in its widthways direction.

The device of the invention for changing an endless felt comprises an elongated lifting beam around which a partially unwound endless felt can be passed. The first end of the lifting beam comprises fixing elements for attaching it to the first end of the first roller. Similarly, the first end of the first roller is provided with counter elements corresponding to the fixing elements, allowing the lifting beam and the first roller to be rigidly attached to each other. Thus, the first end of the roller can be raised by hoisting the lifting beam, whereupon the felt can be passed from the lifting beam into its position around the rollers.

The felt changing device preferably comprises a hoisting device for raising the lifting beam while it is being attached to the first end of the first roller and for raising the lifting beam attached to the first roller. Depending on the case, the hoisting device used may consist of e.g. a beam hoist present in the factory hall, another separate hoist, hydraulic jacks, a forklift truck that can be driven to the place if necessary, and so on.

The lifting beam preferably consists of a substantially round, elongated body, which may be of a solid structure or which may consist of a gridded or latticed structure, bars or some other structure, It may also have a round shape only in its upper surface, i.e. in the portion carrying the felt.

In a preferred case, the surface of the is elongated body, at least in its upper part, comprises sliding elements, rollers, rolls, wheels or equivalent, mounted on axles transverse to the longitudinal direction of the lifting beam, carrying the belt and allowing it to be readily moved in the longitudinal direction of the lifting beam.

The felt changing device preferably comprises a supporting frame which bears the lifting beam. The supporting frame may be provided with hoist brackets by which the entire felt changing device can be moved and hoisted using suitable hoisting apparatus, such as cranes. Likewise, the supporting frame may be provided with wheels, in which case the whole felt changing device can be pushed or pulled along the floor. The lifting beam is preferably attached to the supporting frame mainly by one end only so that it is free of any supporting attachments to the supporting frame at least in its length covered by the total width of the felt. This allows a partially unwound felt roll to be pushed completely onto the lifting beam without creasing or bending the felt.

In an embodiment of the invention, the supporting frame comprises hoisting means below a fixedly mounted lifting beam, e.g. hydraulic jacks or equivalent, which can be used to adjust the vertical position of the lifting beam relative to the machine room floor below.

The fixing elements and their counter elements used preferably consist of various pins, bars, shaft stubs and tightly fitting counter elements fitted inside or outside them which have a sufficient length in the axial direction of the roller and lifting beam so that the lifting beam and the roller can be attached to each other substantially rigidly.

In the felt changing device of the invention, the felt can be moved relatively lightly in a straight condition onto the lifting beam and from the lifting beam into position around the rollers by merely pushing and pulling by hand. However, in an embodiment of the invention, the felt changing device comprises transfer means, pulling or pushing means, which can be used to move the felt. Such means may consist e.g. of catches attached to the edge of the felt and a wire rope extending from it, allowing the felt to be moved by pulling at the wire rope, manually or mechanically.

In an embodiment of the invention, the felt changing device comprises transfer elements by means of which the rollers inside the felt can be moved closer to each other and to the vicinity of the first roller. The first roller is preferably supported by a bearing bracket structure provided with sockets for the other rollers inside the felt. Thus, when the other rollers are brought close to the first roller, they can be held in place in the sockets while the felt is being passed around them.

The device and procedure of the invention for changing a felt have significant advantages as compared with prior art. Preparations for a felt change can be made in advance by bringing a felt changing device to the spot and placing the felt in it while the machine is still running. The felt remains straight and clean during the entire changing operation because it need not be spread out before installation. Neither is the felt creased or bent because it can be unwound from the roll directly in its place of use. The time and down-time required for the installation proper is reduced to a third of the corresponding time needed when prior-art techniques are used. Moreover, when installed, the felt is at once straight and clean and ready for use without any cleaning operations as are required in prior art. A further significant advantage is that a simpler and lighter structure can be used in the machine, such as a press. The press frame can be constructed without edgings and it need not be provided with heavy cantilever girders, which means a significant space saving on the driving side as well as significant savings in construction expenses.

Figure 2:
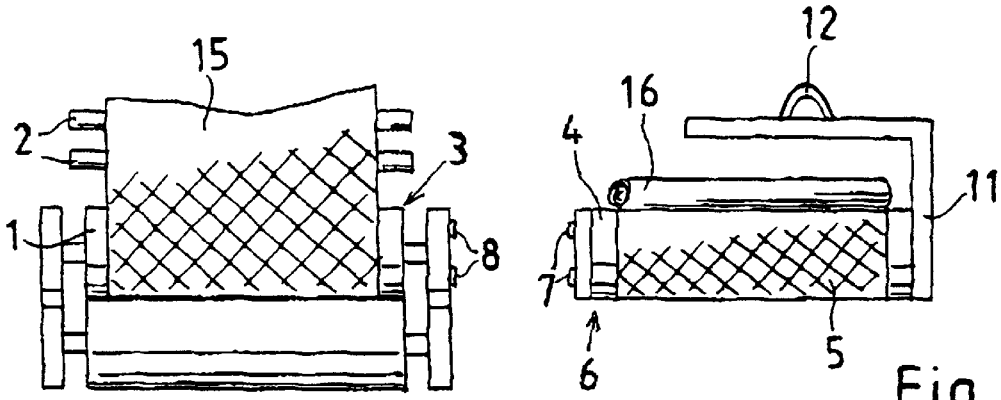
Figure 3:
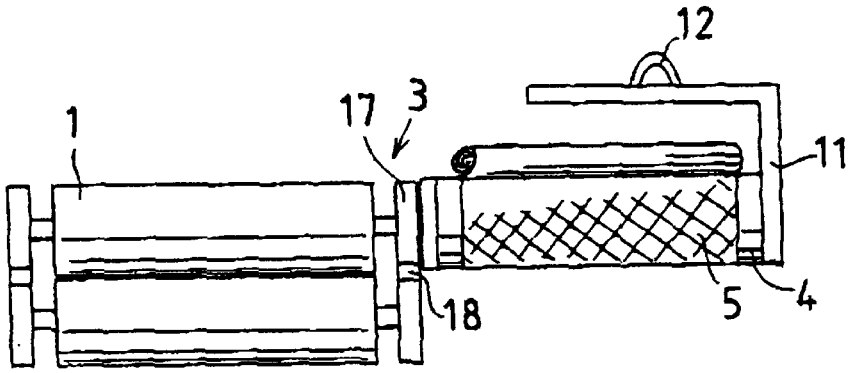
Figure 4:
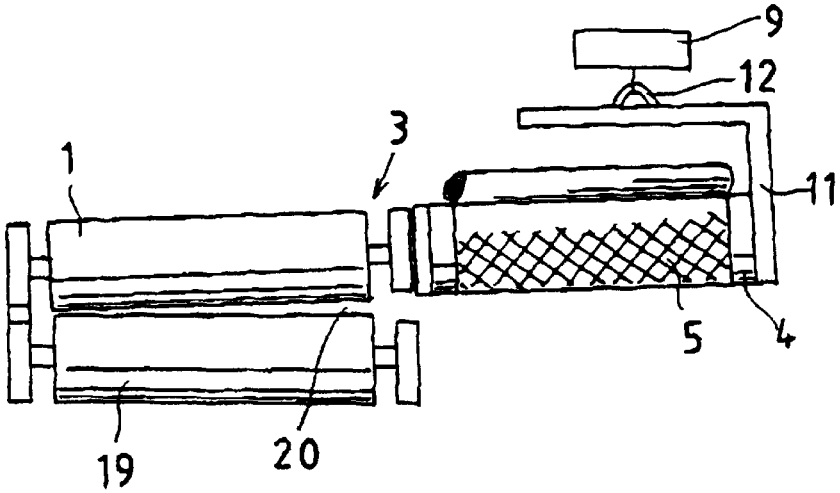
Figure 5:
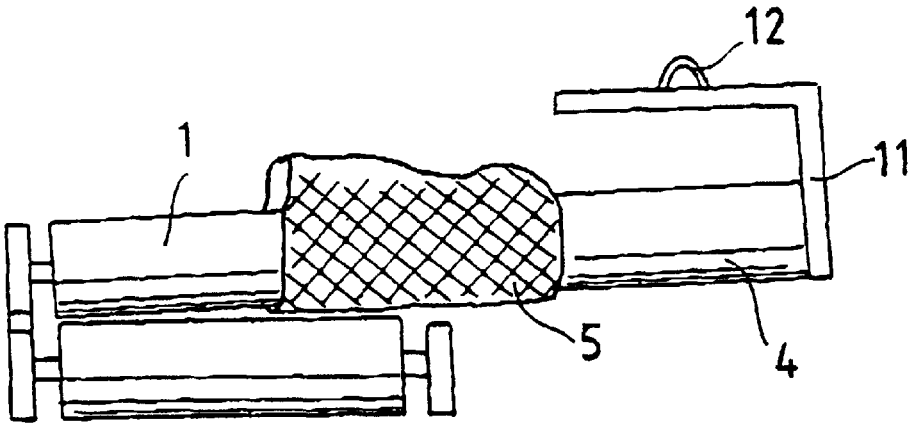
Figure 6:
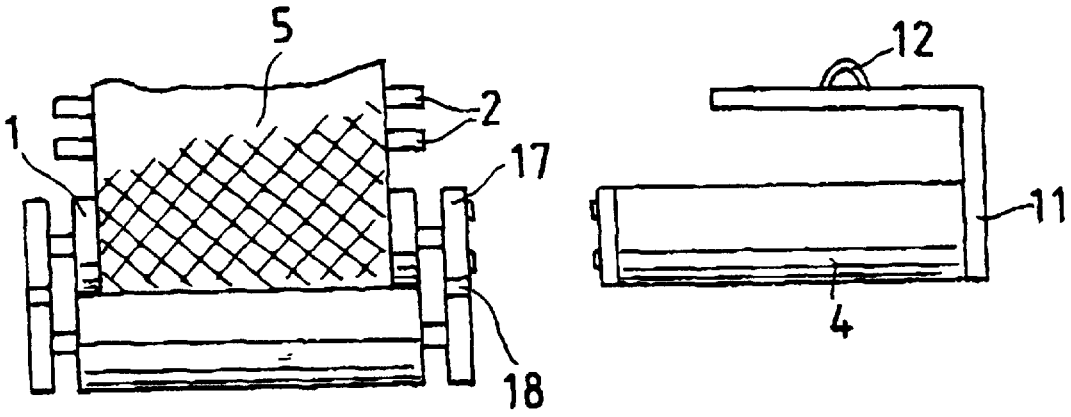
Figure 7:
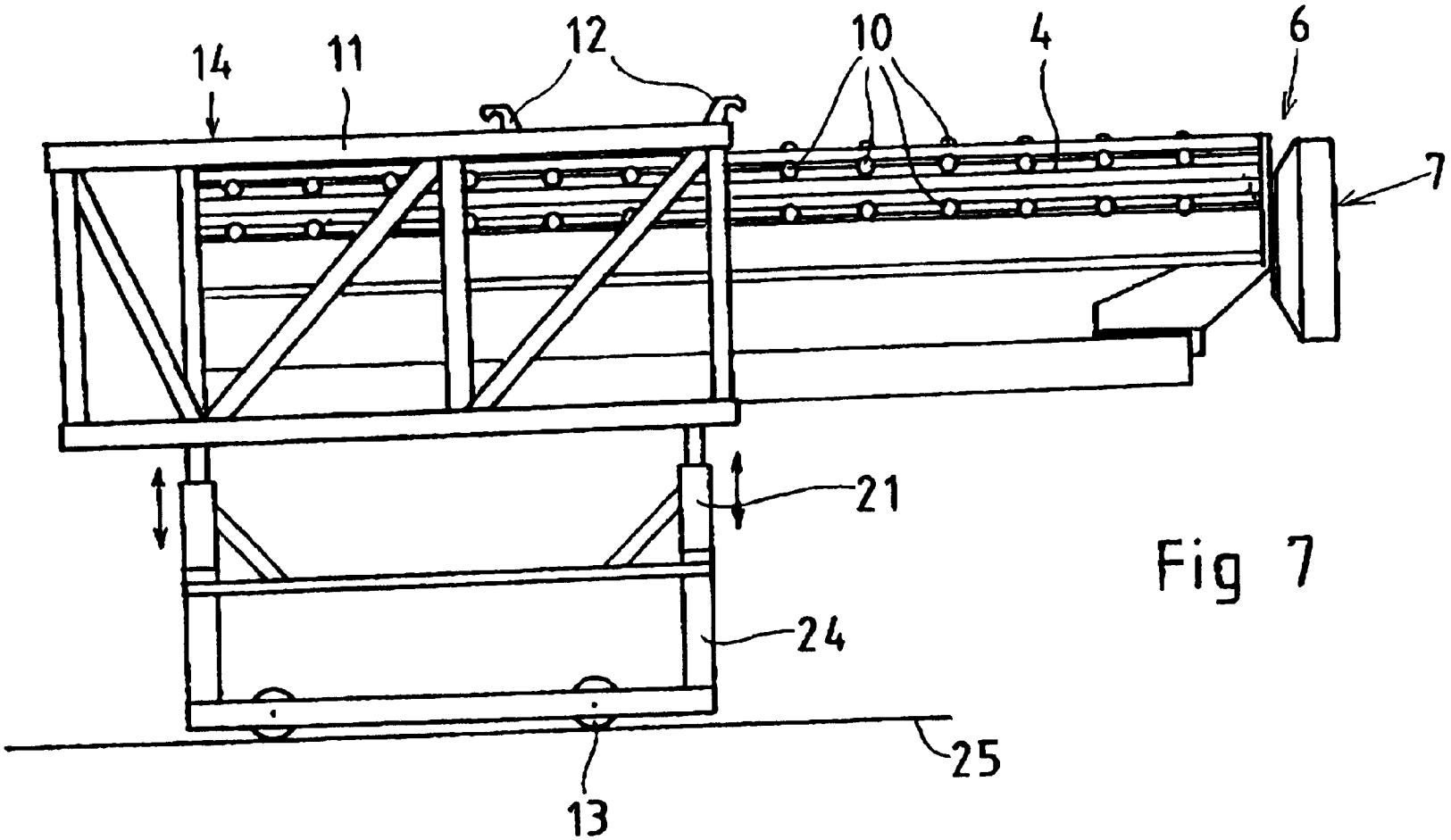
Figure 8:
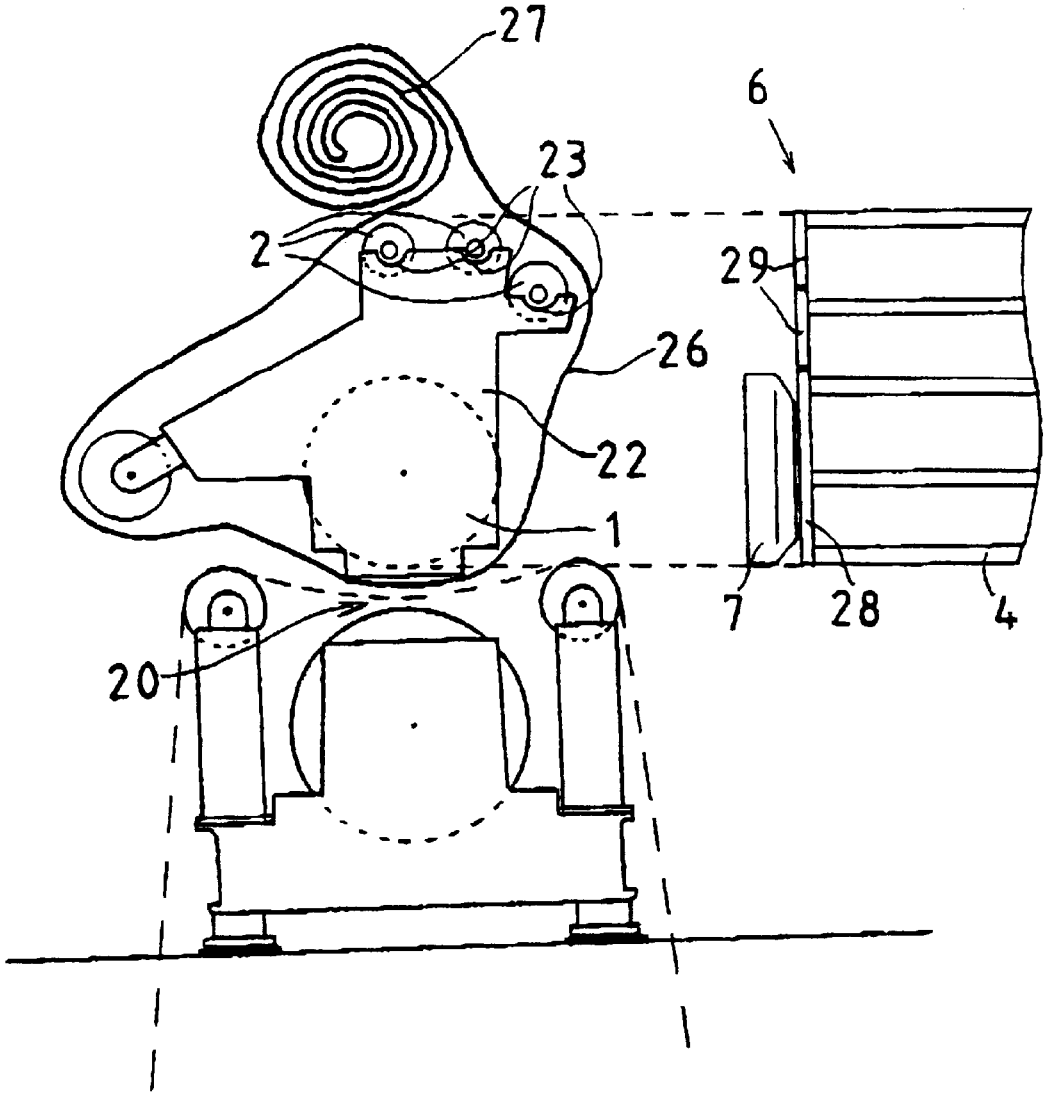

In the following, the invention will be described in detail by referring to the attached drawings, wherein FIG. 1 presents a device for changing an endless felt according to the invention, FIG. 2 is a diagram illustrating the first phase of the procedure of the invention, FIG. 3 is a diagram illustrating the second phase of the procedure of the invention, FIG. 4 is a diagram illustrating the third phase of the procedure of the invention, FIG. 5 is a diagram illustrating the fourth phase of the procedure of the invention, FIG. 6 is a diagram illustrating the fifth phase of the procedure of the invention, FIG. 7 presents another felt changing device according to the invention, and FIG. 8 presents a bearing bracket structure and a lifting beam used in conjunction with it.

A device according to the invention for changing an endless felt as illustrated by FIG. 1 comprises an elongated lifting beam 4 of circular cross-section in its upper portion. The upper surface of the lifting beam is provided with a large number of small rollers 10 acting as sliding elements, mounted in both longitudinal and transverse directions at a distance from each other. The first end 6 of the lifting beam 4 is provided with fixing elements 7 to permit rigid attachment of the lifting beam to the end of the roller to be lifted. The other end 14 of the lifting beam is rigidly supported on a supporting frame 11 of trussed construction. Mounted on the upper surface of the supporting frame are hoist brackets 12 by which the supporting frame and, together with it, the lifting beam 4 can be hoisted and moved, and the supporting frame is provided with wheels 13 on its underside to permit the supporting frame and lifting beam to be moved on the machine level, i.e. on the floor.

The use of a felt changing device as illustrated by FIG. 1 in conjunction with changing the upper felt of a press and the various phases of the procedure of the invention will now be described by referring to the diagrammatic illustrations in FIGS. 2–6.

As illustrated by FIG. 2, the old felt 15 is removed from the press and the other rollers 2 are brought closer to the upper roller 1 of the press. The rollers inside the felt are preferably moved to the vicinity of the upper roller of the press. A new endless felt 5 has already been placed around the lifting beam 4 of a felt changing device according to the invention, the extra felt portion 16 remaining rolled up on the lifting beam 4. The felt changing device with the new felt on it is lifted by its hoist bracket 12 by means of a hoister and moved into contact with the first end 3 of the upper roller 1. The end of the lifting beam is provided with fixing elements 7 and the first end of the upper roller is provided with counter elements 8, which are connected to each other. In practice, the counter elements 8 are not mounted on the roller 1 itself but on a bearing housing 17, which connects to the lifting beam 4.

After this, in FIG. 3, while the roller is being supported by the lifting beam, the bearing housing attachments can be released and if there is a spacer 18 under the bearing housing, it can be removed.

Next, as illustrated by FIG. 4, using a hoist 9, the entire felt changing device and the upper roller 1 rigidly connected to it are raised, causing the nip 20 between the upper roller 1 and the lower roller 19 to open somewhat at one end. Next, as shown in FIG. 5, the new endless felt 5 placed around the lifting beam 4 is pushed or pulled through the gap 20 between the rollers, the felt being thus moved into position around the upper roller 1 while at the same time the felt roll is unwound and the felt is spread around the other rollers above the upper roller.

As illustrated by FIG. 6, after the felt 5 has been brought into place around the rollers, the spacer 18 is mounted again and the upper roller 1 and its bearing housing 17 are lowered onto the spacer, whereupon the felt changing device can be released from its rigid attachment to the roller. By moving all the rollers inside the felt back to their operating positions, the felt can be tensioned and made ready for use. In this manner, the felt has been installed quickly while keeping it clean and smooth.

FIG. 7 presents an embodiment of the invention that mainly corresponds to the embodiment in FIG. 1, the same reference numbers being used in both figures. This embodiment comprises hydraulic jacks disposed below the supporting frame 11 and acting as lifting means 21, by means of which the supporting frame can be raised and lowered with respect to the machine level 25. This embodiment further comprises an intermediate frame 24 disposed below the lifting means and provided with wheels 13. The number of intermediate frames can be increased and decreased as needed, depending on the lifting and handling height required in each case. The lifting means render the felt changing device independent of the availability of overhead hoists.

FIG. 8 presents a diagram representing an end view of a press and its rollers in conjunction with a felt change. The upper roller 1 of the press is is supported by its end on a bearing bracket structure 22 provided with sockets 23 for three rollers 2 inside the felt 26. Now, when the felt is pushed into the gap below the roller 1, the felt can be brought around all the rollers to remain inside the felt loop in an operating situation, although the roll of felt has only been partially unwound while a portion of the felt still remains rolled up 27. Thus, the felt roll 27 is finally unwound only when the rollers 2 are removed from the bearing bracket structure 22 back to their operating positions proper.

In addition, FIG. 8 shows the first end 6 of the lifting beam 4, which is provided with fixing elements 7 for attachment of the lifting beam to the end of the roller. The shape and spread of the lifting beam in the direction of its cross-section are adjustable, or variable according to the size of the loop of felt needed when the felt is being passed into its position around the rollers. Therefore, the lifting beam may comprise a fixed part 28 and one or more movable, turnable or adjustable parts 29, which are connected to the fixed part e.g. via joints or telescopic structures. Thus, e.g. in the embodiment in FIG. 8, the lifting beam 4 has been enlarged in cross-section by considering the positions of the rollers 1 and 2 so that the felt around the lifting beam can be pulled directly onto all these rollers. Therefore, the felt need not be unwound when it is being passed onto the rollers, thus allowing significantly faster and easier installation of the felt.

In the foregoing, the invention has been described by way of example by the aid of the attached drawings, but different embodiments of the invention are possible within the scope of the inventive idea defined by the claims.

What is claimed is:

1. Procedure for changing an endless felt, in which procedure an endless felt is placed around rollers by raising a first roller (1) and passing felt around said first roller and other rollers (2) to go inside a felt loop, comprising:

attaching an elongated lifting beam (4), with the endless felt (5) placed around the elongated beam (4), to a first end (3) of the first roller (1), releasing fixtures holding the first end of the first roller, raising the first end of the first roller supported by the lifting beam, passing the felt around the lifting beam under the first roller and around the first roller and the other rollers (2) to go inside the felt loop, lowering and securing the first roller, and releasing the lifting beam from the first roller.

2. Procedure as defined in claim 1, further comprising, before the felt is passed into position, moving the first roller and the other rollers (1, 2) to go inside the felt closer to each other.

3. Procedure as defined in claim 1, further comprising, after the felt has been installed, tightening the felt by moving the first roller and the other rollers (1, 2) inside the felt farther apart from each other.

4. Procedure as defined in claim 1, wherein the procedure is applied to change a felt in a press of a chemical pulp, paper or cardboard machine.

5. Procedure as defined in claim 4, wherein the first roller (19) is the upper roller of the press.

6. Procedure as defined in claim 1, further comprising unwinding from a roll of felt a portion of the felt (5) sufficient to allow the portion to be placed around the lifting beam (4).

7. Procedure as defined in claim 6, wherein a portion of the felt (5) not yet unwound is left resting on top of the lifting beam (4).

8. Felt changing device for placing an endless felt around rollers, comprising:

an elongated lifting beam (4) around which a partially unwound endless felt (5) can be placed, a first end (6) of the lifting beam is provided with fixing elements (7) for attaching the first end to a first end (3) of a first roller (1), and the first end of the first roller is provided with counter elements (8) for the fixing elements to allow the lifting beam to be rigidly attached to the first end of the first roller so that the first roller can be supported by means of the lifting beam while the felt is being installed.

9. Felt changing device as defined in claim 8, further comprising a hoisting means (9, 21) for hoisting the lifting beam attached to the first roller to allow the first roller to be raised and the felt to be passed from a position around the lifting beam into a position around the first roller and other rollers (1, 2).

10. Felt changing device as defined in claim 8, wherein the lifting beam (4) consists of an elongated body of substantially circular cross-section.

11. Felt changing device as defined in claim 10, wherein a surface of the elongated body is provided with sliding elements (10) on which the felt can be slid in a longitudinal direction of the lifting beam.

12. Felt changing device as defined in claim 8, further comprising a supporting frame (11) which bears the lifting beam (4).

13. Felt changing device as defined in claim 12, wherein the supporting frame (11) is provided with hoist brackets (12) to allow the felt changing device to be hoisted and moved.

14. Felt changing device as defined in claim 12, wherein the supporting frame (11) is provided with wheels (13) to allow the felt changing device to be moved.

15. Felt changing device as defined in claim 12, wherein the supporting frame comprises hoisting means (21) to allow the supporting frame to be raised and lowered.

16. Felt changing device as defined in claim 8, wherein the felt changing device is used in a chemical pulp, paper or cardboard machine assembly.

17. Felt changing device as defined in claim 8, wherein the fixing elements and their counter elements are fitted to attach the lifting beam and the first roller rigidly together.

18. Felt changing device as defined in claim 8, further comprising a transfer means for moving a belt into position around the lifting beam and from the lifting beam into position around the first roller and the other rollers.

19. Felt changing device as defined in claim 8, further comprising a transfer means for moving the other rollers (2) inside the felt close to the first roller (1).

20. Felt changing device as defined in claim 19, wherein the first roller (1) is supported by a bearing bracket structure (22) provided with sockets (23) for holding the other rollers inside the felt in a position close to the first roller.

* * * * *